US006651718B2

(12) United States Patent
Hua

(10) Patent No.: US 6,651,718 B2
(45) Date of Patent: Nov. 25, 2003

(54) HAND-HELD TAPE DISPENSER WITH TAPE POSITIONING STRUCTURE

(76) Inventor: Wei-Hsiu Hua, 7F-3, No. 76, Sec. 3, Rooselvelt Rd., Taipei (TW)

( * ) Notice: Subject to any disclaimer, the term of this patent is extended or adjusted under 35 U.S.C. 154(b) by 101 days.

(21) Appl. No.: 10/052,557

(22) Filed: Jan. 23, 2002

(65) Prior Publication Data

US 2003/0136522 A1 Jul. 24, 2003

(51) Int. Cl.[7] ..... B32B 31/00
(52) U.S. Cl. ..... 156/523; 156/577; 156/579
(58) Field of Search ..... 156/574, 577, 156/579, 523, 527; 225/72, 73, 74, 75, 56, 63, 64, 65

(56) References Cited

U.S. PATENT DOCUMENTS 4,961,525 A * 10/1990 Corbo et al. ..... 225/65
5,634,580 A * 6/1997 Levy ..... 225/56
5,788,807 A * 8/1998 Gratz ..... 156/577

* cited by examiner

*Primary Examiner*—Richard Crispino
*Assistant Examiner*—Cheryl N. Hawkins
(74) *Attorney, Agent, or Firm*—Rosenberg, Klein & Lee

(57) ABSTRACT

A hand-held tape dispenser with tape positioning structure mainly includes a tape reel from which a length of tape is dispensed and applied onto a surface, and a holding-down plate adapted to push a blade below it to cut the dispensed tape. The tape positioning structure includes two L-shaped plates fixed to two sides of the blade. Each of the two L-shaped plates has a hooked front end exposed from one side of a front plate located below the blade. When the blade is pushed forward to cut the dispensed tape, the hooked front ends of the L-shaped plates move forward at the same time to hook up a free end of the cut tape, and when the holding-down plate is released and the blade retracts, the cut tape is held by the retracted hooked front ends to the front plate for use next time.

2 Claims, 6 Drawing Sheets

HAND-HELD TAPE DISPENSER WITH TAPE POSITIONING STRUCTURE

BACKGROUND OF THE INVENTION

The present invention relates to a hand-held tape dispenser with tape positioning structure, and more particularly to a hand-held tape dispenser having means for holding a free end of a cut tape in place to facilitate convenient use of the tape next time.

A conventional hand-held tape dispenser is shown in FIGS. 1 and 2 and typically includes a main body 1 having a handle, a tape reel 11 provided at a rear side of the main body 1, a roller 12 provided at a front side of the main body 1, a front plate 13 located above the roller 12, a blade 14 located above the front plate 13, and a holding-down plate 15 located above and substantially normal to the blade 14. The blade 14 is connected to the front plate 13 with a spring to elastically move forward and backward relative to the front plate 13. To use the conventional hand-held tape dispenser, a free end of a roll of tape 2 mounted on the tape reel 11 is pulled to pass below the roller 12 and attach to a surface of, for example, a packing box. By pressing and rotating the roller 12, a desired length of tape 2 is firmly adhered to the packing box. Thereafter, the tape dispenser is lifted to press the holding-down plate 15 against the tape 2 applied on the packing box. At this point, the depressed holding-down plate 15 pushes the blade 14 forward to extend beyond the front plate 13 and cut the tape 2.

Since the tape 2 on the hand-held tape dispenser has an adhesive side facing downward, and there is not any means to hold the tape 2 below the roller 12 in place, a free end of the cut tape 2 depends from the roller 12 and tends to stick to other surface or corrugate into a mass. When the tape 2 is to be used next time, the corrugated free end must be cut off and pulled straight. This is, of course, very inconvenient to the user and has adverse influence on the packing efficiency.

SUMMARY OF THE INVENTION

It is therefore a primary object of the present invention to provide a hand-held tape dispenser with tape positioning structure, so that a free end of the tape on the tape dispenser having been cut by the blade is closely held by the tape positioning structure to the front plate below the blade without depending from the roller and could be directly used for packing next time without the need of pulling it straight.

The tape positioning structure includes two sideward projections near rear ends of two sides of the blade, and two L-shaped plates fixed to two sides of the blade. Each of the two L-shaped plates has a hooked front end exposed from one side of a front plate located below the blade. When the blade is pushed forward by the holding-down plate to cut the dispensed tape, the hooked front ends of the L-shaped plates move forward at the same time to hook up a free end of the cut tape, and when the holding-down plate is released and the blade retracts, the cut tape is held by the hooked front ends of the retracted L-shaped plates to the front plate for use next time.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
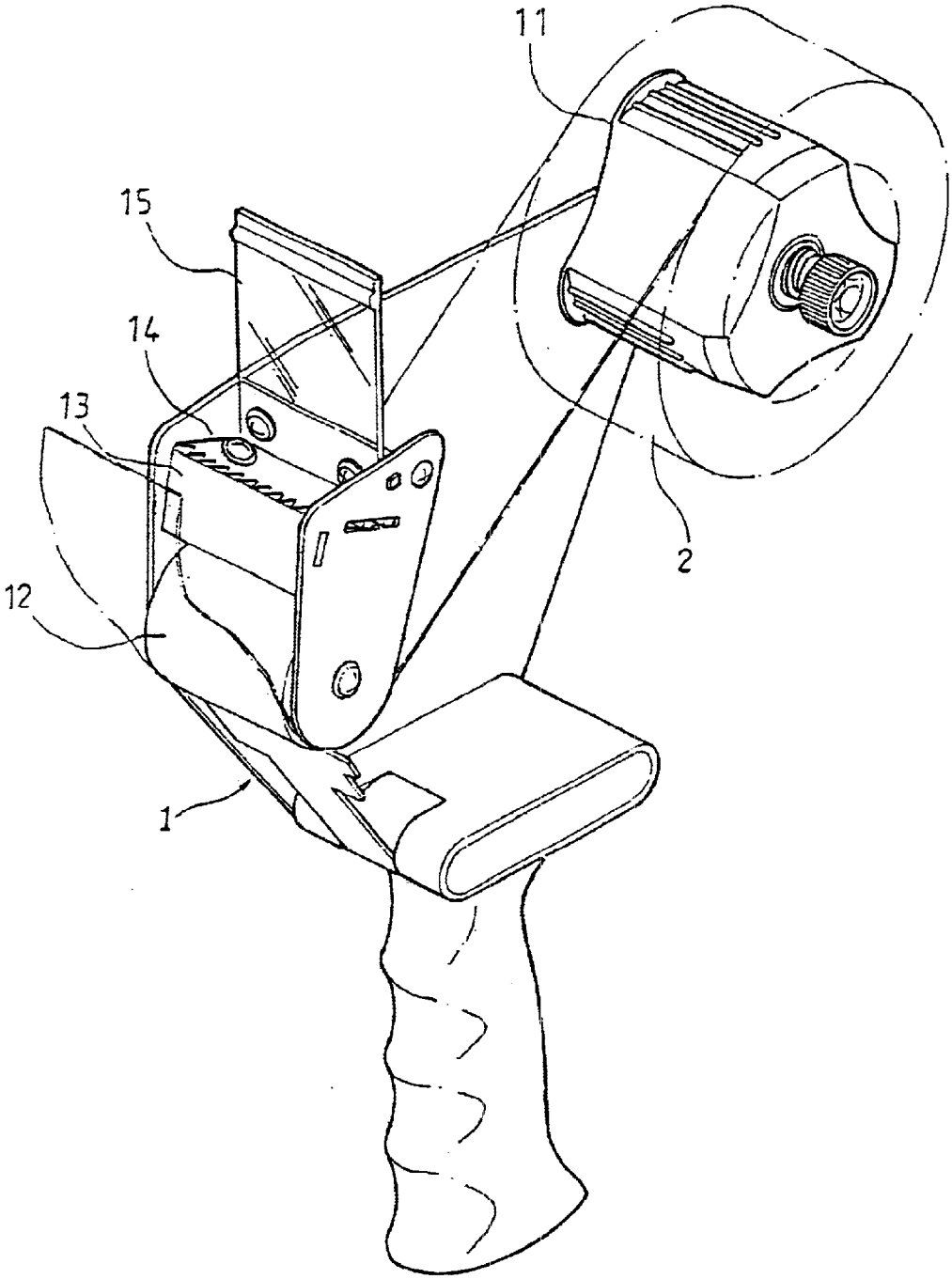
FIG 1 PRIOR ART
FIG. 1 is a perspective view of a conventional hand-held tape dispenser.
Figure 2:
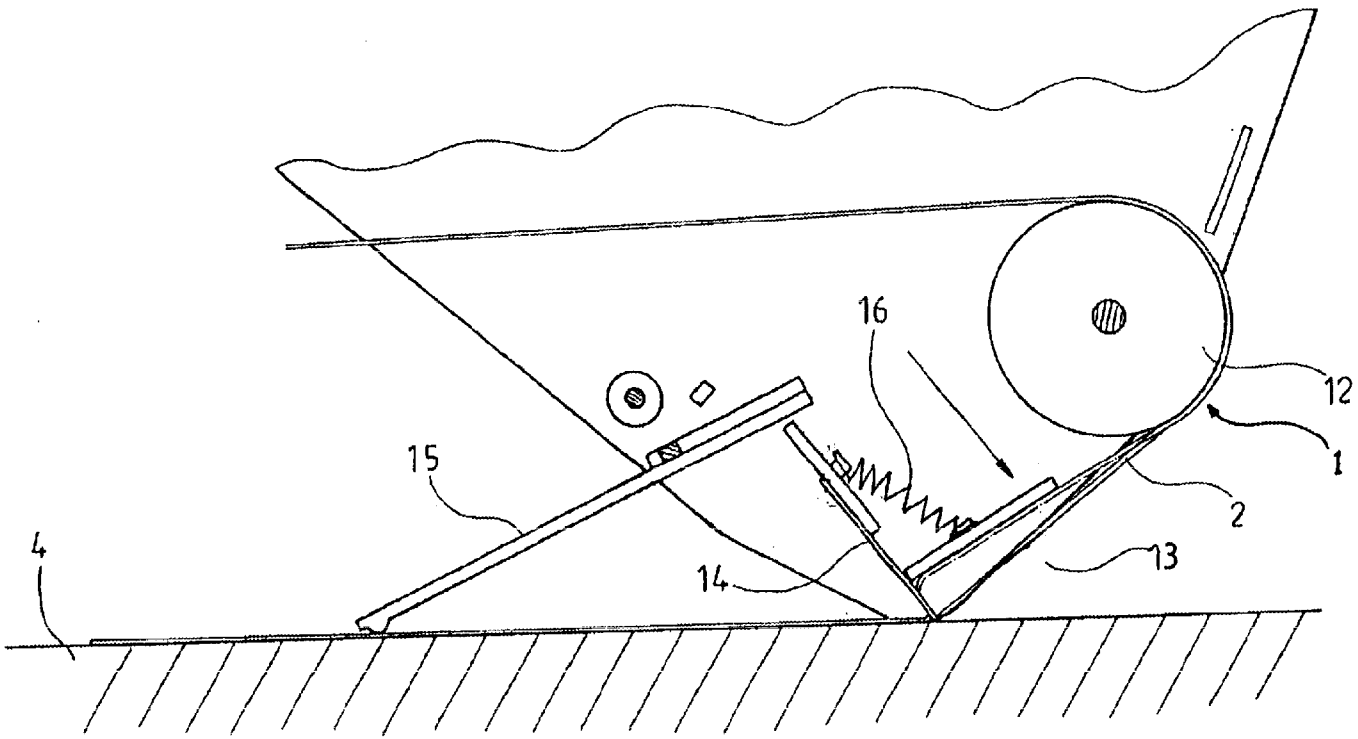
FIG.2 PRIOR ART
FIG. 2 is a fragmentary side view showing the operation of the conventional hand-held tape dispenser of FIG. 1.
Figure 3:
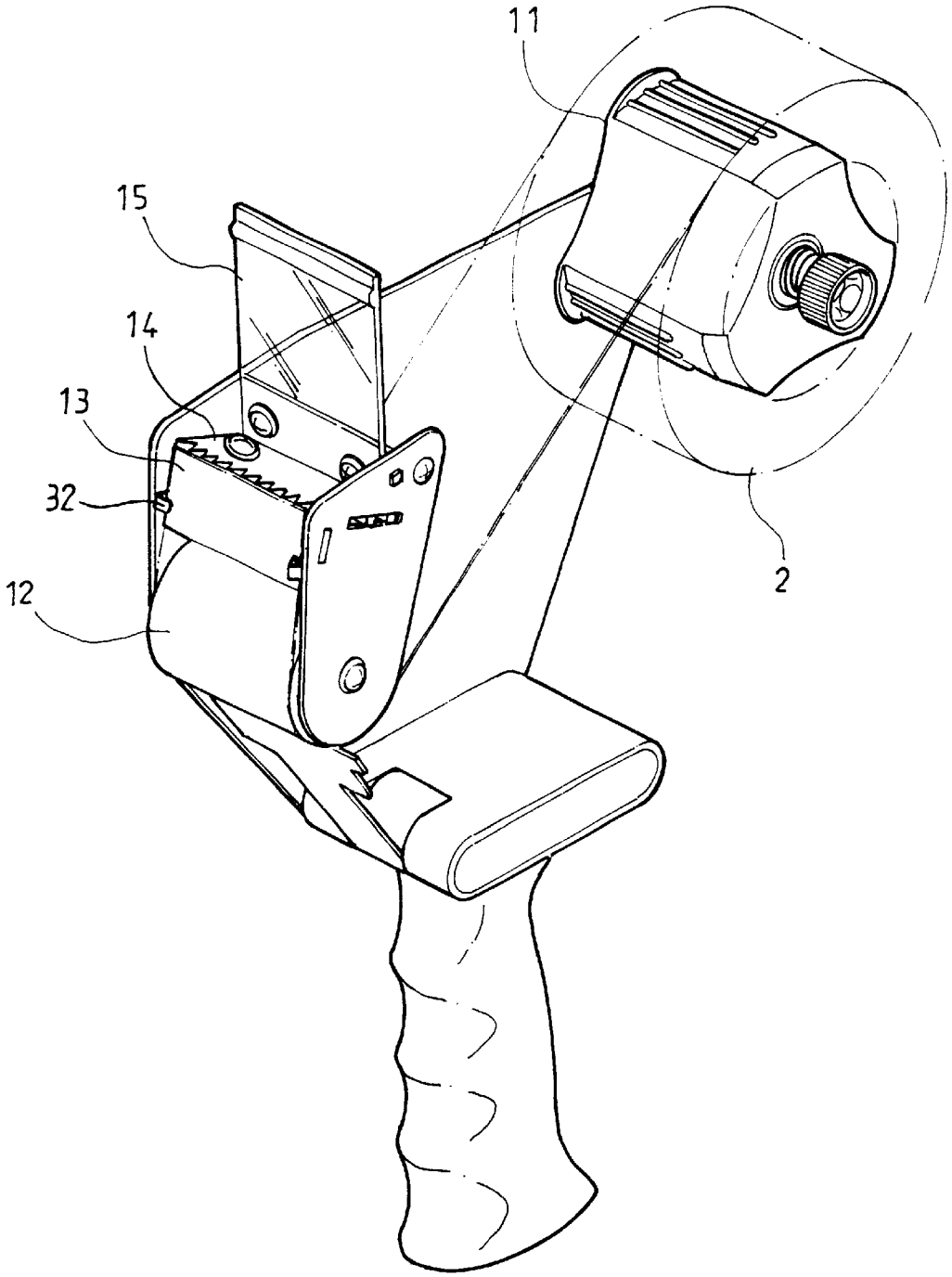
FIG. 3 is an assembled perspective view of a hand-held tape dispenser with tape positioning structure according to the present invention.
Figure 4:
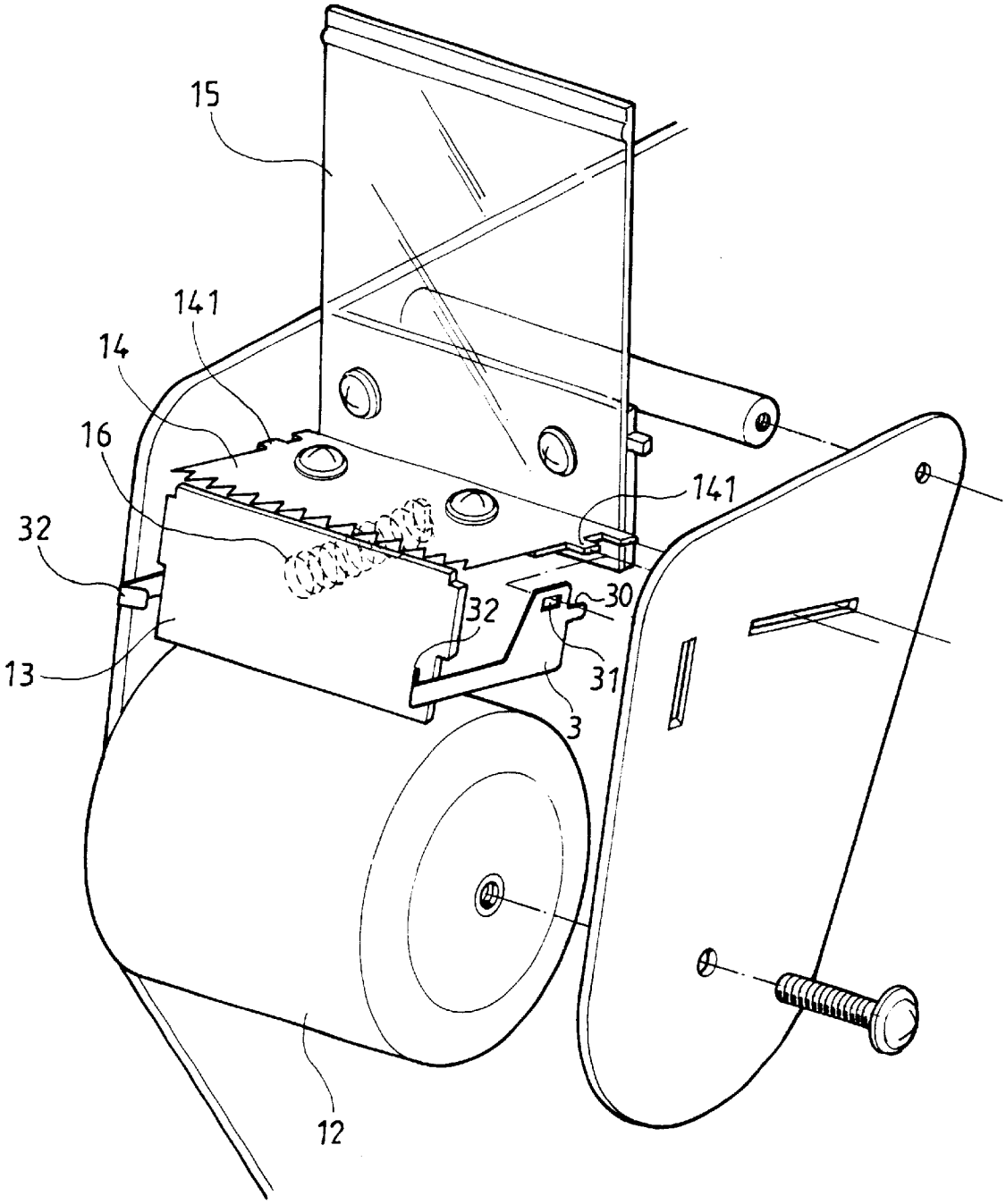
FIG. 4 is an exploded perspective view of the hand-held tape dispenser of FIG. 3.

Please refer to FIGS. 3 and 4 that are assembled and exploded perspective views, respectively, of a hand-held tape dispenser with tape positioning structure according to the present invention. As a conventional hand-held tape dispenser, the hand-held tape dispenser of the present invention also includes a tape reel 11, a roller 12, a front plate 13, a blade 14, a holding-down plate 15, and a spring 16. Similarly, the blade 14 is connected to the front plate 13 with the spring 16 to elastically move forward and backward within a predetermined range relative to the front plate 13. When the holding-down plate 15 is brought to press against a length of dispensed tape 2, it pushes the blade 14 forward to project from the front plate 13 and cut the tape 2. When the tape dispenser is lifted to release the holding-down plate 15 from the dispensed tape 2, the blade 14 is pulled backward by the spring 16 to locate behind the front plate 13 again.

The hand-held tape dispenser of the present invention is different from the conventional ones in a tape positioning structure. The tape positioning structure includes two sideward projections 141 near rear ends of two sides of the blade 14, and two generally L-shaped plates 3 fixed to two sides of the blade 14. Each of the two L-shaped plates 3 is formed at a rear upper part with a fixing hole 31 for engaging with the sideward projection 141 of the blade 14, and at an upper portion of a rear edge with a horizontally backward extended stopper 30 for pressing against a bottom side of the blade 14 behind the sideward projection 141. A lower front part of the L-shaped plate 3 extends forward by a predetermined length and has a hooked front end 32 that is normally exposed from one side of the front plate 13 below the blade 14. When the blade 14 is pushed forward by the holding-down plate 15 to cut the dispensed tape 2, the L-shaped plates 3 connected to two sides of the blade 14 move forward along with the blade 14.

Figure 5:
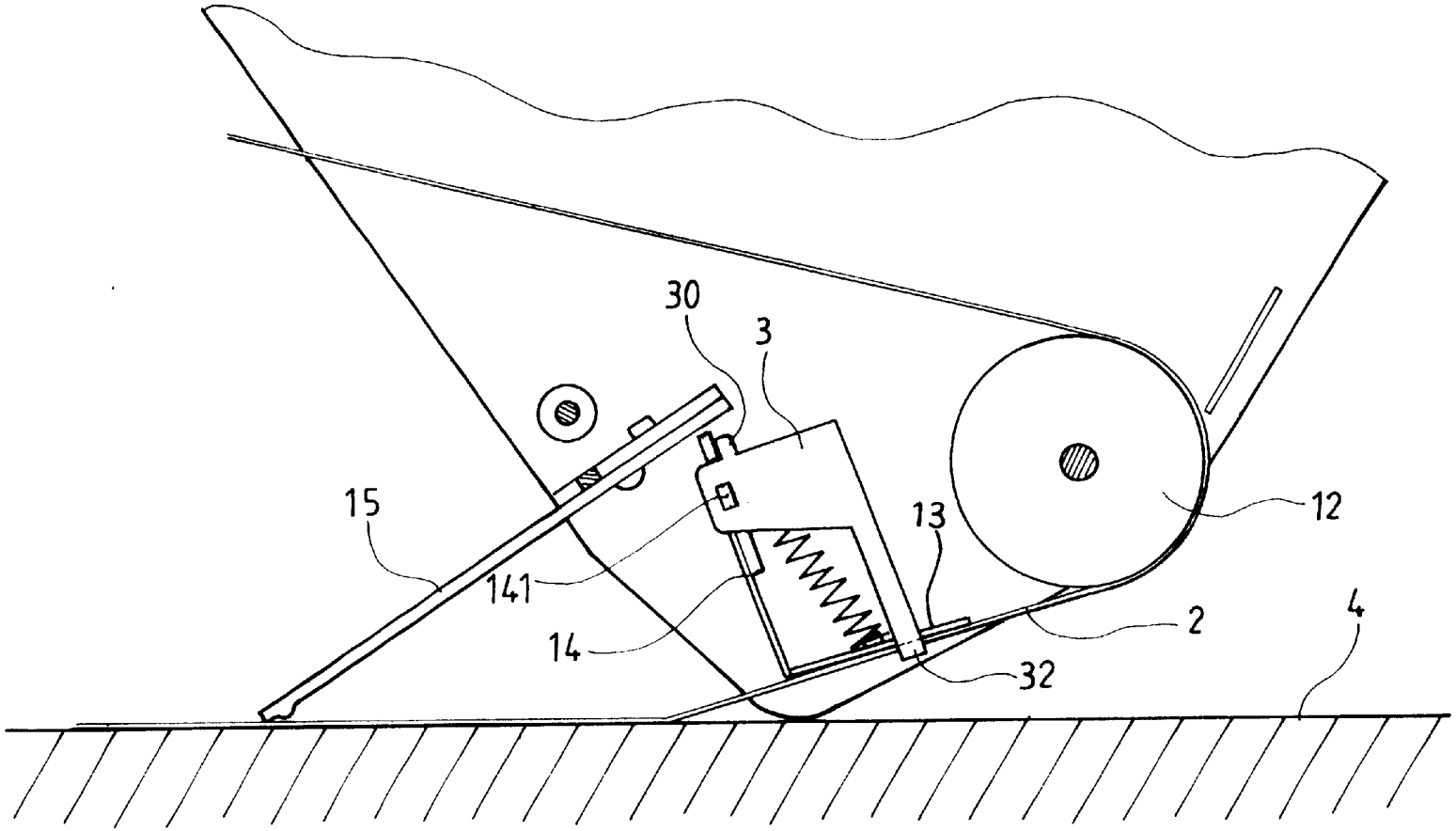
FIG. 5 is a fragmentary side view showing the hand-held tape dispenser of FIG. 3 is operated to dispense and apply a length of tape on a surface.
Figure 6:
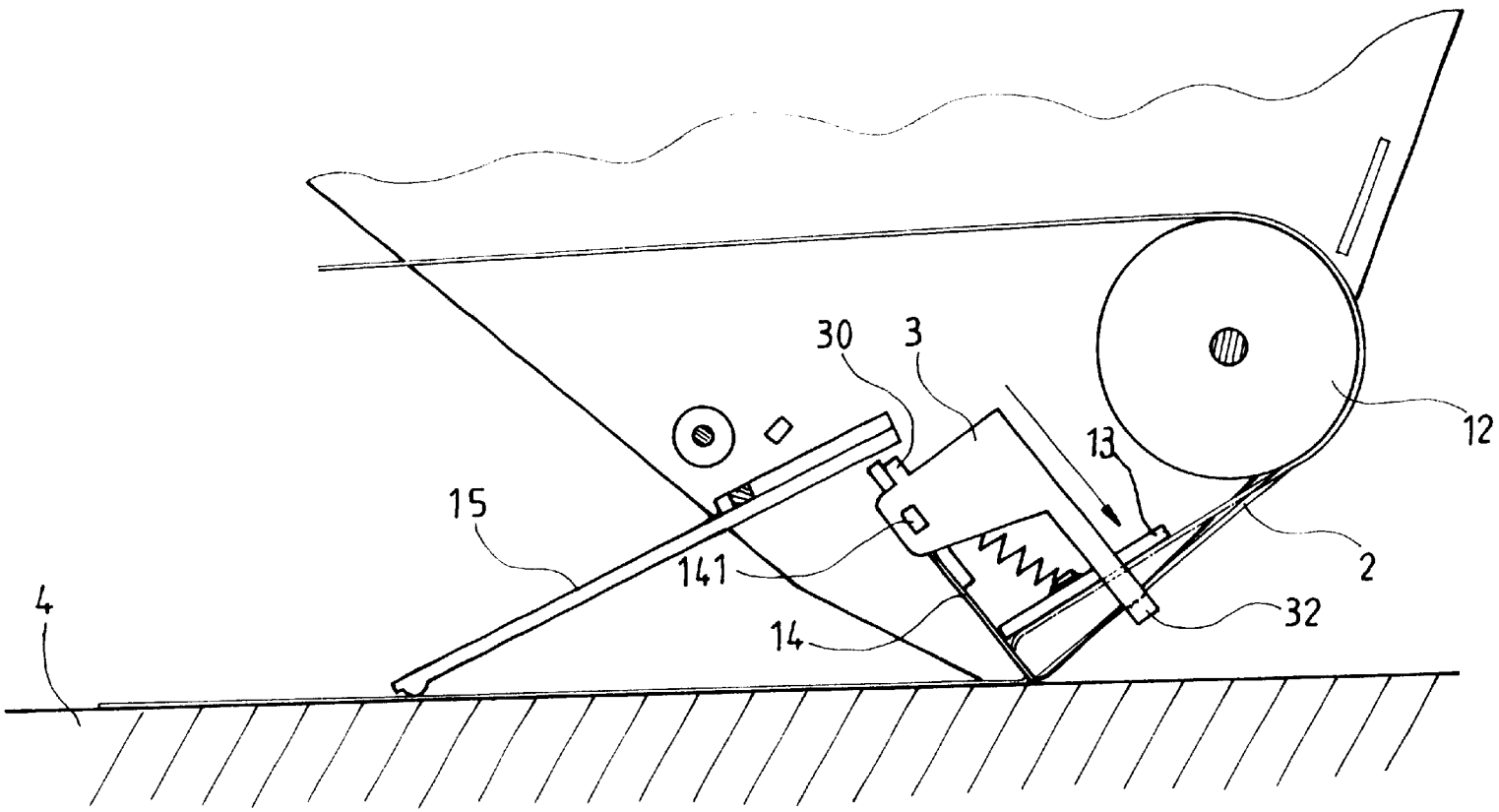
FIG. 6 is a fragmentary side view showing the hand-held tape dispenser of FIG. 3 is operated to cut the tape.

Please refer to FIGS. 5 and 6 that are fragmentary side views showing the manner in which the blade 14 of the hand-held tape dispenser of the present invention operates to cut the tape 2 and the hooked front ends 32 of the L-shaped plates 3 hook up two sides of a free end of the cut tape 2 to flatly attach the latter to the front plate 13 for use next time.

As shown in FIG. 5, after a desired length of tape 2 is dispensed and applied onto, for example, a packing box 4 via pressing and rotating the roller 12, the entire hand-held tape dispenser is lifted for the holding-down plate 15 to press a front edge thereof against the applied tape 2. At this point, a rear edge of the holding-down plate 15 applies a downward force against the blade 14 for the latter to move forward beyond the front plate 13 and cut the tape 2, as shown in FIG. 6.

Since the L-shaped plates 3 are fixed to two sides of the blade 14, they move in the same direction as the forward moved blade 14 to expose the two hooked front ends 32 from two sides of the front plate 13, and accordingly, two sides of the tape 2 closely located before the front plate 13. When the blade 14 cuts the tape 2, a free end of the cut tape 2 is immediately caught by the hooked front ends 32 of the L-shaped plates 3. When the hand-held tape dispenser is fully lifted to separate the holding-down plate 15 from the packing box 4, the spring 16 elastically pulls the blade 14 backward to locate behind the front plate 13 again. At this point, the two L-shaped plates 3 also move backward and the free end of the cut tape 2 is held by the hooked front ends 32 to flatly attach to the front plate 13 without depending from the roller 12. The free end of the tape 2 held in this position can be directly applied onto another surface without the need of pulling it straight from a suspended or tangled state. The hand-held tape dispenser with tape positioning structure of the present invention is therefore more convenient and effective for use.

What is claimed is:

1. A hand-held tape dispenser with tape positioning structure, comprising a main body with a handle, a tape reel connected to a rear end of said main body, and a holding-down plate, a blade, a front plate, and a roller sequentially assembled from top to bottom to a front end of said main body; said blade being located above and connected to said front plate via a spring so as to elastically move forward and backward relative to said front plate; said tape reel having a roll of tape wound therearound, such that a free end of said tape is guided to pass below said roller for attaching to a surface; and said tape positioning structure including two sideward projections near rear ends of two sides of said blade, and two generally L-shaped plates fixed to two sides of said blade; each of said two L-shaped plates being formed at a rear upper part with a fixing hole for engaging with said sideward projection of said blade; a lower front part of each said L-shaped plate extending forward by a predetermined length and having a hooked front end that is normally exposed from one side of said front plate below said blade; whereby when said holding-down plate is pressed against said tape applied onto said surface, it pushes said blade to move beyond said front plate and cut said tape, and said L-shaped plates connected to two sides of said blade move forward along with said blade to hook up two sides of a free end of said cut tape and prevent the same from depending from said roller, and when said holding-down plate is released from said tape applied on said surface, said blade is pulled backward by said spring to locate behind said front plate again, and said cut tape is held by said hooked front ends of said L-shaped plates to flatly attach to said front plate for use next time.

2. The hand-held tape dispenser with tape positioning structure as claimed in claim 1, wherein each of said L-shaped plates of said tape positioning structure is provided at an upper portion of a rear edge with a horizontally backward extended stopper for pressing against a bottom side of said blade behind said sideward projection and thereby holding said L-shaped plate in place.

* * * * *